US005131913A

United States Patent [19]

Martini

[11] Patent Number: 5,131,913

[45] Date of Patent: Jul. 21, 1992

[54] PRODUCTION OF PATTERN EFFECTS WHEN DYEING OR PRINTING TEXTILE MATERIAL IN THE ABSENCE OF ALKALI OR REDUCING AGENTS: CATIONIZATION AND OXIDIZED IN A PATTERN BEFORE DYEING

[75] Inventor: Thomas Martini, Kelkheim/Taunus, Fed. Rep. of Germany

[73] Assignee: Hoechst Aktiengesellschaft, Frankfurt am Main, Fed. Rep. of Germany

[21] Appl. No.: 538,102

[22] Filed: Jun. 14, 1990

[30] Foreign Application Priority Data

Jun. 16, 1989 [DE] Fed. Rep. of Germany ..... 3919692
Mar. 6, 1990 [DE] Fed. Rep. of Germany ..... 4006951

[51] Int. Cl.[5] ..... D06P 5/22; D06P 1/52; D06P 3/60

[52] U.S. Cl. ..... 8/448; 8/107; 8/446; 8/449; 8/532; 8/543; 8/551; 8/554; 8/606; 8/652; 8/680; 8/918

[58] Field of Search ..... 8/446, 449, 453, 448, 8/551, 554

[56] References Cited

U.S. PATENT DOCUMENTS

| | | | |
|---|---|---|---|
| 4,412,837 | 11/1983 | Blum et al. | 8/449 |
| 4,588,413 | 5/1986 | Keil et al. | 8/543 |
| 4,680,033 | 7/1987 | Durl et al. | 8/449 |
| 4,806,126 | 2/1989 | Sternberger | 8/543 |
| 4,810,254 | 3/1989 | Bauer et al. | 8/554 |
| 4,914,764 | 4/1990 | Mast et al. | 8/436 |

FOREIGN PATENT DOCUMENTS 376151 7/1990 European Pat. Off. .

OTHER PUBLICATIONS

H. Zollinger "Color Chemistry", (VCH), 1987 pp. 1 and 238.

J. Lenoir in Venkataraman's "The Chemistry of Synthetic Dyes ", vol. V, (Academic Press), 1971, p. 314.

*Primary Examiner*—A. Lionel Clingman

[57] ABSTRACT

Process for producing pattern effects when dyeing or printing textile material in the absence of alkali or reduoing agents, which comprises pretreating the textile material with a cationizing agent, drying, applying an oxidizing agent in the form of a pattern, drying and dyeing or printing with reactive, direct, acid, water-soluble sulfur dyes or pigment dyes in the absence of any alkali or reducing agent.

17 Claims, No Drawings

PRODUCTION OF PATTERN EFFECTS WHEN DYEING OR PRINTING TEXTILE MATERIAL IN THE ABSENCE OF ALKALI OR REDUCING AGENTS: CATIONIZATION AND OXIDIZED IN A PATTERN BEFORE DYEING

The dyeing of textile materials, e.g. woven fabrics, knitted fabrics or else spun and filament yarns, consisting of or containing cellulose fibers with reactive dyes can be effected by known methods by treating the textile material in the manner of an exhaust method with a dyeing liquor containing a reactive dye, usually at elevated temperature and with most commercial reactive dyes in the presence of alkali, or by employing continuous or batchwise processes, e.g. the pad-steam process or the cold pad-batch process. In both the pad-steam and the cold pad-batch processes, the textile material is first padded with a reactive dye liquor and the necessary fixing alkali is customarily applied in a separate impregnating step. In the pad-steam process, the dye is then fixed by steaming, whereas in the cold pad-batch process it is fixed by putting the impregnated material on a roller and leaving it at room temperature in that state for several hours. There are yet other ways of fixing the dye which are practiced in industry, for example treating the material which has been padded with an alkali-free reactive dye liquor with a sodium hydroxide/sodium silicate solution.

All the reactive dyeing processes mentioned produce a covalent chemical bond between the dye molecule and the cellulose molecule in the course of the dyeing process. For this the presence of an alkali is absolutely necessary in every case.

EP Application 0 284 010 describes a process for dyeing cellulose fibers with reactive dyes where the presence of alkali is not necessary. The dye is fixed on the fibers in this process by pretreating the fibers before the dyeing process with a cationizing agent, for example in the form of a reaction product of polyethyleneimine and a bifunctional alkylating agent.

All these dyeing processes are designed to achieve a highly uniform distribution of the dyes across the entire length and width of the textile material.

In a further embodiment of the process described in EP Application 0 284 010, it has now been found that this method of dyeing or even printing in the absence of alkali can also be used to produce pattern effects by applying to the textile material, after it has been treated with the cationizing agent, an oxidizing agent in the form of a pattern.

The present invention accordingly provides a process for producing pattern effects when dyeing or printing textile material in the absence of alkali or reducing agents, which comprises pretreating the textile material with a cationizing agent, drying, applying an oxidizing agent in the form of a pattern, drying and dyeing or printing with reactive, direct, acid, water-soluble sulfur dyes or pigment dyes in the absence of any alkali or reducing agent.

The textile material to be dyed or printed is wholly made of cotton or comprises a mixture of cotton with other fibers of the synthetic or natural kind. This textile material, which can take the form of a ready-made woven or knitted fabric or is in yarn form, is first treated with a cationizing agent. Cationizing agents are generally known in dyeing and printing; they are primarily used for aftertreating dyed textile material in order to improve the fastness properties of the dyeings. For the purposes of the present invention preference is given to the following cationizing agents:

I.

Reaction products of polyethyleneimines of the formula $$H-(CH_2-CH_2-NH)_a-(CH_2-CH_2-\underset{\underset{X}{|}}{N})_b-H \qquad (I)$$

where

X is a radical of the formula $-(CH_2-CH_2-NH-)_c-H$, a and b are independently of each other from 0 to 600 and the sum a+b is from 60 to 600, and c is from 0 to 50, with bifunctional alkylating agents, preferably those alkylating agents of the formula (II)

$$A-Z-A \qquad (II)$$

where A is the radical of an alkylating species and Z is either a direct bond or a divalent bridge member.

Of particular suitability for reaction with polyethyleneimines to give auxiliaries for use according to the present invention are those bifunctional alkylating agents of the formula II where A is a group of the formula $-CH_2-Y$, where Y is a substituent which is detachable as an anion, in particular chlorine, bromine, iodine or —OH, or a group which is detachable as an anion, in particular sulfato, sulfonyloxy, in particular phenylsulfonyloxy or p-tolylsulfonyloxy, or epoxy

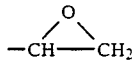

and Z, if it is not a direct bond, is a divalent straight-chain or branched radical of the formula (III)

$$-C_nH_{2n}- \qquad (III)$$

where n is from 1 to 4, a divalent radical of the formula IV $$-C_mH_{2m}-D-C_mH_{2m}-(tm \ (IV)$$

where m is 1 or 2 and D is —O—, —S—, —NH—, —CO—, —SO— or $-SO_2-$, or is phenylene.

Preference for the reaction with polyethyleneimine to give auxiliaries to be used accosting to the present invention is given to those bifunctional alkylating agents where A is a group of the formula $-CH_2-Y$ and these groups are linked by a bridge member of the formula IV, or to those where one A is a group of the formula $-CH_2-Y$ which is bonded directly to an epoxy group.

Examples of such bifunctional alkylating agents are epichlorohydrin, glycide, 1,3-dichloropropan-2-ol, β,β'-dichlorodiethyl ether, β,β'-dichlorodiethylamine, β,β'-dichlorodiethyl sulfide, β,β'-dichlorodiethyl sulfoxide, β,β'-dichlorodiethyl sulfone, β,β'-disulfatoethyl ether, β,β'-diphenylsulfonyloxyethyl ether, meta- or para-diepoxyethylbenzene, meta- or para-diepoxypropylbenzene, diepoxybutane, diepoxy-2-methylbutane and diepoxypropylamine.

These reaction products with polyethyleneimine are described in detail in U.S. Pat. No. 4,588,413. These reaction products can also be quaternized with $C_1$–$C_4$-alkyl, preferably $C_1$–$C_3$-alkyl. The quaternization can be effected with alkyl halides, preferably alkyl chlorides, or dialkyl sulfates in a conventional manner.

II.

Reaction products of an epichlorohydrin and ammonia or an amine of the formula

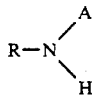

where

A is hydrogen, alkyl of 1 to 5 carbon atoms or hydroxyalkyl of 1 to 5 carbon atoms, R is alkyl of 1 to 5 carbon atoms, hydroxyalkyl of 1 to 5 carbon atoms, a group of the formula

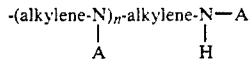

(n=0 to 5), a group of the formula

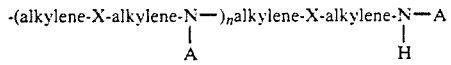

(X=oxygen or sulfur) (n=0 to 5), or R and A together are

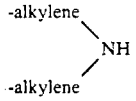

and alkylene is in each case $C_1$–$C_6$-alkylene, preferably $C_2$-$C_3$-alkylene.

These cationizing agents are prepared by reacting an epihalohydrin, preferably epichlorohydrin, with ammonia or an amine of the stated formula at temperatures of about 60° to 70° C. in water or a lower alcohol as solvent. If desired, these cationizing agents may also be quaternized, for example with $C_1$–$C_4$-dialkyl sulfates or $C_1$–$C_4$-alkyl chlorides.

Amines conforming to the above-indicated formula are for example: monomethylamine, monoethylamine, monopropylamine, monoisopropylamine, monobutylamine, monoisobutylamine, monohydroxyethylamine, monohydroxypropylamine, ethylenediamine, diaminopropane, diaminobutane, diaminohexane, 3,3'-diaminodipropyl ether, piperazine, monohydroxyethylethylenediamine, dihydroxyethylethylenediamine, diethylenetriamine, dipropylenetriamine, triethylenetetramine, and others.

The preparation of these cationizing agents is described in detail in DE-A-1 619 391.

III.

Polymeric cationizing agent consisting wholly or in part of monomeric units of the formula

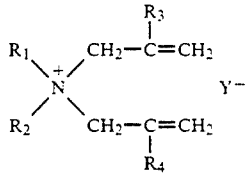

where $R^1$ and $R^2$ are each hydrogen, $C_1$–$C_{22}$-alkyl which may be interrupted by —CO—NH— or —NH—CO—, or $C_1$–$C_4$-hydroxyalkyl, $R^3$ and $R^4$ are each hydrogen or methyl, and Y is a monovalent anion or one equivalent of a polyvalent anion.

These prior art cationizing agents are applied to the textile material to be dyed or printed from an aqueous liquor together with a wetting or padding agent customary in the textile industry.

The wetting or padding agents used for this purpose are alkanesulfonates, dialkyl sulfosuccinates, dialkyl phosphates or propylene oxide/ethylene oxide block copolymers containing 40–80% by weight of ethylene oxide, but in particular nonionic compounds, for example ethoxylated nonylphenol.

The pretreatment with the auxiliary together with a nonionic wetting agent takes place from an aqueous liquor in a conventional manner by padding or by the exhaust method at temperatures ranging from about 20° to 80° C. to the boil. The liquor is adjusted to a weakly acid pH, preferably pH 3–6. The amount of auxiliary is about 0.5 to 10%, preferably 3 to 8%, on weight of fiber. The amount of wetting agent is preferably 2 to 4 g/l.

Applied by the exhaust method, the cationizing agent goes on in the course of 5–20 minutes. In the continuous process a subsequent drying process between room temperature and 120° C. is sufficient. The pretreatment liquor is dropped and the textile material is dried.

The textile material thus pretreated then has applied to it an oxidizing agent in the form of a pattern. Suitable oxidizing agents are in particular persulfate, sodium chlorite, sodium hypochlorite, perborates, hydrogen peroxide and chlorine-containing amides, e.g. N-chloro-N-methylparatoluenesulfonamide. These oxidizing agents are customarily used in the form of formulations which in addition to the oxidizing agent contain thickeners, wetting agents, dispersants, antifoams, stabilizers and other assistants. Suitable assistants for addition to the oxidizing agent are in particular those of anionic character, for example anionic wetting agents, detergents and dispersants. The audition of anionic assistants likewise serves to eliminate the cationizing effect of the cationizing agent and enhances the resist effects.

These oxidizing agents are applied to the textile material in the form of aqueous formulations containing approximately 0.05 to 50% by weight of oxidizing agent. The liquor pickup is about 5 to 200% by weight. The oxidizing agent is applied by uniform or nonuniform spraying, printing, brushing or similar techniques. The oxidizing agent can also be applied to the textile material in the form of a pattern, for example with a stencil. The textile material is then dried and rinsed cold.

A preferred version of the process comprises treating warp yarn in a conventional manner with a sizing agent composition which additionally contains a cationizing agent. After drying, the warp yarn is then incorporated in a woven fabric which is then treated with the oxidizing agent. The presence of a sizing agent, for example polyvinyl alcohol or a starch size, has the effect of enhancing the crispness of the pattern effects.

The textile material thus pretreated with oxidizing agent is then dyed in a conventional manner and on conventional equipment with direct, reactive or sulfo-containing sulfur dyes or, preferably if the cationizing agent III was used, with pigment dyes, for example by the cold pad-batch technique or by an exhaust technique. The liquor ratio here can be about 3:1 to 40:1. However, it is important here—in contradistinction to the previously customary process—that no alkali or reducing agent is used in the present case.

Possible pigment dyes are all customary pigment types, for example azo, phthalocyanine or quinacridone pigments. These pigments are commercially available in the form of aqueous dispersions having a dispersant content and are also used in the commercial form in the process according to the present invention. The amount of pigment dye may be chosen to produce 0.1 to 6% strength dyeings, but in individual cases, for example if fluorescent pigments are applied, it is also possible to achieve up to 15% strength dyeings.

In addition to pigment dye and perhaps a salt, for example sodium chloride or sodium sulfate, the dyeing liquor advantageously also contains a leveling or dispersing agent. It is possible to use for this purpose any of the products which are customary in dyeing; specific examples are the commercial products Eganal® PS, Solidegal® GL or Dispersogen® ASN. These assistants, which prevent a specky dyeing, are added to the liquor in an amount of about 1 to 8%, preferably 3 to 4%, on weight of fiber.

This pigment dyeing liquor is applied to the textile material by an exhaust method on customary equipment for this purpose, for example a dyeing jet, a drum type washing machine or a reel beck. The dyeing time is approximately 5 to 20 minutes and the dyeing temperature is 30 to 90° C., preferably 70° C. High-speed machines have proved advantageous here.

After the dyeing has ended, a salt may be added in an amount of 1 to 5% by weight, preferably 3% by weight, on weight of fiber, to the dyeing liquor to increase the ionic strength. In this case the textile material is subsequently agitated in the dyeing liquor for a further 10 minutes. Preference is given to using sodium chloride or alum. These salts improve the affinity of the pigment dye for the fiber and increase the levelness. After the dyeing process has ended, the textile material is rinsed cold and dried.

To obtain maximum fastness of the pigment dye on the fiber, it is possible additionally to apply a pigment binder to the material after the dyeing process. Suitable for this purpose are the customary pigment binders, for example the commercial products Imperon® Binder CFN or Imperon® Binder MTB. These binders are applied in a conventional manner, again by an exhaust method at 20°-60° C. preferably at 40° C., in the course of 5-20, preferably 7-15, minutes. The liquor is adjusted with an acid to a pH of 3 to 6. The amount of pigment binder is approximately 1 to 10% by weight, on weight of fiber. The binder is then crosslinked in a subsequent hot air treatment at 100° to 200° C., preferably at 140° to 170° C., in the course of 2 to 10 minutes, preferably 5 minutes.

Special effects can be produced by washing the textile material between the actual dyeing and the application of the binder with a surfactant in the presence or absence of sodium carbonate. The duration of this wash is about 5 to 10 minutes, and its temperature is 40° to 60° C. This intermediate wash produces wash-out effects on the textile material. But even without this intermediate wash the process according to the present invention produces, in particular in the case of madeup goods, for example jeans articles, so-called stonewash effects.

These effects are normally only obtainable in an additional time-consuming operation, namely with the use of stones and further chemicals, which, however, has an adverse effect on the integrity of the cotton.

Possible reactive dyes for this process are all known types of reactive dyes which contain groups which are reactive toward the hydroxyl groups of cellulose and, under the dyeing conditions described according to the present invention, preferentially react with the above-described polymers fixed on the cellulose material. The reactive groups are for example groups having readily detachable substituents which leave behind an electrophilic radical, such as reactive groups of the vinyl sulfone type, halogen-substituted groups of the ring systems quinoxaline, phthalazine, triazine, pyrimidine or pyridazone, or alkylsulfonyl-substituted reactive groups in the case of sulfonylpyrimidine or sulfonylbenzothiazole dyes. Dyes worth mentioning specifically have the reactive groups β-sulfatoethyl sulfone, β-chloroethyl sulfone, β-thiosulfatoethyl sulfone, β-phosphatoethyl sulfone, chlorotriazinylamino, dichlorotriazinylamino, chlorotriazinyldiamino, trichloropyrimidylamino, dichloropyrimidylamino, dichloropyridazinylamino, trichloropyridazinylamino, dichloropyridazinylcarbonylamino, 2-chlorobenzothiazol-6-ylamino, 2-methylsulfonylbenzothiazol-6-ylamino, 2,3-dichloroquinoxalin-6-ylcarbonylamino and 4-chloro-5-methyl-2-methylsulfonylpyrimid-3ylamino.

Suitable parent structures for the reactive dyes are for example water-soluble azo, disazo, formazan, anthraquinone, dioxazine or phthalocyanine dyes. Preference is given to using water-soluble azo and disazo reactive dyes which can also be metal complex reactive dyes. After dyeing, the textile material is finished by rinsing, possibly soaping and drying.

The process according to the present invention can be carried out not only with reactive dyes but in the same way also with other types of dyes which contain anionic, for example sulfo, groups, such as direct dyes and acid dyes.

These dyes produce similar effects and fastness levels as the reactive dyes. If water-soluble sulfur dyes are used, particularly high lightfastness properties are obtained. In addition, the process can also be carried out with vat and sulfur vat dyes.

The process according to the present invention is also suitable for printing. This involves printing the textile material with a print paste which contains the auxiliary to be used according to the present invention with or without a sighting dye. After drying, the textile material is then cross-dyed with reactive dyes without alkali or in the case of water-soluble sulfur dyes without a reducing agent, preferably by the pad-steam process or by the exhaust process. Another possibility is to print the cotton warps or fabrics pretreated with the auxiliary described with a print paste which contains the reactive dye but no alkali and then to fix the dye, for example by steaming at 102°-105° C. for 8 minutes. The subsequent aftertreatment is carried out in the same way as for dyeings.

In the process according to the present invention, those areas on the textile material where the oxidizing agent is applied are dyed only very little or not at all, depending on the amount of oxidizing agent applied. This produces patterns having very crisp contours as otherwise only obtainable in printing, for example in discharge printing to white. The process according to the present invention is particularly interesting for the exhaust dyeing of garments.

EXAMPLE 1

Cotton warp yarns are treated as follows in the size box of a sizing machine:

40 g/l of polyvinyl alcohol (PVA)
5 g/l of polyethylene glycol
2 g/l of nonionic wetting agent
100 g/l of polyethyleneimine condensation product as per the example in Table 1, last line, of Patent Application EP 0 133 933

Liquor pickup 100–200% (high-performance squeeze rollers).

The yarn speed is 60 m/min, the liquor temperature is 80°–90° C.

On leaving the size box the cotton warps are contact dried at about 130° C. Instead of PVA it is also possible to use nonionic modified starch or mixtures of nonionically modified starch and PVA. It is also possible to use pure starch and mixtures with PVA. The cotton warps are then interwoven with the cotton weft to produce a woven fabric to which is applied, by means of a brush, an aqueous 1:10 dilution of a commercially available persulfate-containing oxidizing agent (®Leonil EBL) in an arbitrary pattern, so that the liquor pickup in the wetted area is about 50% on weight of fiber. The impregnated fabric is dried at room temperature and dyed for 30 minutes at 60° C. with a liquor containing 5% by weight of Reactive Blue 19 (C.I. No. 61200). The customary after-treatment of rinsing, soaping and rinsing leaves denim effects where, on the one hand, only the cationized warp has been dyed a turquoise blue shade and, on the other, the persulfate-impregnated areas remain crisply undyed, showing the desired pattern.

An additional resist effect can be produced by applying the oxidizing agent locally to the moving, dried warp.

EXAMPLE 2

Example 1 is repeated, except that the oxidizing agent used is a 50% strength sodium chlorite solution which was diluted 1:10. The effects are similar to Example 1.

EXAMPLE 3

Example 1 is repeated, except that the oxidizing agent used is a solution containing 0.2 g/l of active chlorine in the form of hypochlorite. The effects are similar to Example 1.

EXAMPLE 4

Example 1 is repeated, except that the oxidizing agent used is a solution containing 3.5% of $H_2O_2$. The result is excellent contour crispness and pattern reproduction.

EXAMPLE 5

Example 1 is repeated, except that the oxidizing agent used is a 10% strength sodium perborate solution. The result is crisp contour reproduction with somewhat reduced bleachout effects.

EXAMPLE 6

Example 1 is repeated, except that the cationizing agent added to the size is a commercially available condensation product of diethylenetriamine and epichlorohydrin. The results correspond to those of Example 1.

EXAMPLE 7

Example 1 is repeated, except that the dye used is 5% by weight of Solubilized Sulfur Red 11. The results correspond to those of Example 1.

EXAMPLE 8

Example 1 is repeated, except that the dye used is 5% by weight of Solubilized Sulfur Brown 16 (C.I. 53286). The effects obtained are the same as in Example 1.

EXAMPLE 9

Example 1 is repeated, except that the oxidizing agent used is a 10% strength solution of N-chloro-N-methylparatoluenesulfonamide. The results correspond to those of Example 1.

EXAMPLE 10

Cotton or viscose material is padded with a solution of 100 g/l of a cationizing agent consisting of the copolymer of Example 5 of EP-A-277 580 to a wet pickup of 80% at pH 5–6. After drying at about 120° C., for example in a drying cabinet (10 min), the oxidizing agent is applied in the form of a print paste consisting of 100 g/l of a persulfate-based oxidizing agent containing an anionic wetting agent,
400 g/l of antimigration agent (®Solidokoll N),
500 g/l of water.

This is followed by drying at 120° C., then dyeing with 5% of Pigment Violet 23 (C.I. 51319) at 50°–60° C. for 10 minutes and then rinsing. In an aftertreatment, 5% of a pigment binder based on a copolymer of ethylene acrylate and butyl acrylate was applied at 40° C. in the course of 5 minutes. The binder is then condensed at 150° C. for 5 minutes without rinsing.

After drying, the material shows a deep, substantially level dyeing with a clear reproduction of the imprinted pattern and a surprisingly soft hand for binder finishes.

EXAMPLE 11

A pair of cotton jeans is pretreated in an industrial drum type washing machine at 70° C. for 10 minutes in a liquor ratio of 30:1 with a liquor containing 2% of a modified fatty acid amide (Humectol ® C).

This has a thorough wetting and also finishing effect on the jeans. Since the wetting agent has lubricating properties, the mechanical wear and tear is also reduced.

After this treatment, the liquor is dropped and the jeans are thoroughly rinsed with cold water.

They are then cationized at 70° C. for 10 minutes with a fresh aqueous liquor containing 5% of the copolymer of Example 5 of EP-A-277 580 and
2% of 60% strength acetic acid.

Following a cold rinse, the jeans are dried and the oxidizing agent is applied as described under Example 1. After drying once more at 120° C., the jeans are again treated at 70° C. for 10 minutes with a fresh aqueous liquor containing 5% of Pigment Violet 23 (C.I. 51319)

3% of a dispersant (a heterocyclic, nitrogen-containing compound or an ethoxylated higher alcohol).

This is followed by an addition of

3% of sodium chloride or sodium sulfate.

After a further 10 minutes, the dyeing process is completed by cold rinsing.

After drying, the jeans have a deep, somewhat unlevel, stonewashed appearance. The fastness levels are similar to those of indigo jeans.

The pattern imprinted with the oxidizing agent has crisp contours.

I claim:

1. A process for producing pattern effects when dyeing or printing textile material comprising cotton or a mixture of cotton with synthetic fibers or other natural fibers in the absence of alkali or reducing agents, which comprises pretreating the textile material with a cationizing agent selected rom one of the following compounds:

(a) a quaternized or unquaternized reaction product of a polyethyleneimine of the formula I $$H-(CH_2-CH_2-NH)_a-(CH_2-CH_2-\underset{\underset{X}{|}}{N})_b-H \qquad (I)$$

where

X is a radial of the formula $-(CH_2-CH_2-NH-)_c-H$, a and b are independently of each other from 0 to 600 and the sum a+b is from 60 to 600, and c is from 0 to 50, with bifunctional alkylating agents, wherein said bifunctional alkylating agent is of the formula $$A'-Z'-A'$$

where A' is the group of the formula $-CH_2-Y$, where Y is a substituent which is chlorine, bromine, iodine, —OH, sulfato, sulfonyloxy, or epoxy and Z' is either a direct bond or a divalent straight-chain or branched radical of the formula (III)

$$-C_{n'}N_{2n'} \qquad (III)$$

where n' is from 1 to 4, a divalent radical of the formula (IV)

$$-C_mH_{2m}-D-C_mH_{2m}- \qquad (IV)$$

where m is 1 or 2 and D is —O—, —S—, —NH—, —CO—, —SO—, $-SO_2-$ or phenylene, (b) a quaternized or unquaternized reaction product of an epichlorohydrin and ammonia or an amine of the formula II

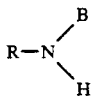

(II)

wherein

B is hydrogen, alkyl of 1 to 5 carbon atoms or hydroxyalkyl of 1 to 5 carbon atoms, R is alkyl of 1 to 5 carbon atoms, hydroxyalkyl of 1 to 5 carbon atoms, a group of the formula $$(\text{alkylene-NB})_n\text{-alkylene-}\underset{\underset{H}{|}}{N}-B$$

n=0 to 5, a group of the formula $$\text{-(alkylene-Z-alkylene-NB)}_n\text{alkylene-Z-alkylene-}\underset{\underset{H}{|}}{N}-B$$

Z=oxygen or sulfur, and n is 0 to 5, or R and B together are

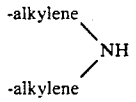

and alkylene is in each case $C_1$-$C_6$-alkylene, or (c) a polymeric agent comprised of monomeric units of the formula (III)'

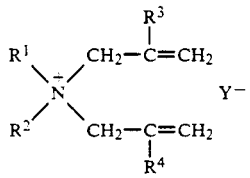

(III)' wherein $R^1$ and $R^2$ are each hydrogen, $C_1$-$C_{22}$-alkyl which can be interrupted by —CO—NH— or —NH—CO—, or $C_1$-$C_4$-hydroxyalkyl, $R^3$ and $R^4$ are each hydrogen or methyl, and Y is a monovalent anion or one equivalent of a polyvalent anion, drying, applying an oxidizing agent in the form of a pattern, drying and dyeing or printing with reactive, direct, acid, or water-soluble sulfur dyes in the absence of any alkali or reducing agent.

2. A process for producing pattern effects when dyeing textile material comprising cotton or a mixture of cotton with synthetic fibers or other natural fibers in the absence of alkali or reducing agents, which comprises pretreating warp yarn simultaneously with a cationizing agent selected from one of the following compounds:

(a) a quaternized or unquaternized reaction product of a polyethylene of the formula $$H-(CH_2-CH_2-NH)_a-(CH_2-CH_2-\underset{\underset{X}{|}}{N})_b-H \qquad (I)$$

where

X is a radical of the formula $-(CH_2-CH_2-NH-)_c-H$, a and b are independently of each other from 0 to 600 and the sum a+b is from 60 to 600, and c is from 0 to 50, with bifunctional alkylating agents, wherein said bifunctional alkylating agent is of the formula $A'—Z'—A'$ where A' is the group of the formula $—CH_2—Y$; where Y is a substituent which is chlorine, bromine, iodine, —OH, sulfato, sulfonyloxy, or epoxy and Z' is either a direct boned or a divalent straight-chain or branched radical of the formula (II)

$$—C_{n'}H_{2n'}— \quad \text{(III)}$$

where n' is from 1 to 4, a divalent radical of the formula (IV)

$$—C_mH_{2m}—D—C_mH_{2m}— \quad \text{(IV)}$$

where m is 1 or 2 and D is —O—, —S—, —NH—, —CO—, —SO—, $—SO_2—$ or phenylene, (b) a quaternized or unquaternized reaction product of an epichlorohydrin and ammonia or an amine of the formula II

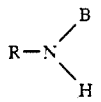

(II)

where

B is hydrogen, alkyl of 1 to 5 carbon atoms or hydroxyalkyl of 1 to 5 carbon atoms, R is alkyl of 1 to 5 carbon atoms, hydroxyalkyl of 1 to 5 carbon atoms, a group of the formula $$(\text{alkylene-NB})_n\text{-alkylene-}\underset{\underset{H}{|}}{N}—B$$

n=0 to 5, a group of the formula $$\text{-(alkylene-Z-alkylene-NB)}_n\text{alkylene-Z-alkylene-}\underset{\underset{H}{|}}{N}—B$$

Z=oxygen or sulfur, and n is 0 to 5, or R and B together are

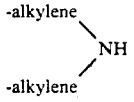

and alkylene is in each case $C_1$–$C_6$alkylene, or (c) a polymeric agent comprised of monomeric units of the formula (III)'

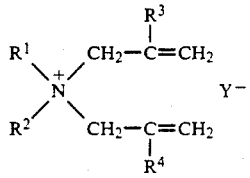

(III)' where $R^1$ and $R^2$ are each hydrogen, $C_1$–$C_{22}$-alkyl which can be interrupted by —CO—NH— or —NH—CO—, or $C_1$–$C_4$-hydroxyalkyl, $R^3$ and $R^4$ are each hydrogen or methyl, and Y is a monovalent anion or one equivalent of a polyvalent anion, and a sizing agent, drying, then interweaving the warp yearn with a weft yarn, applying an oxidizing agent to the resulting fabric in the form of a pattern, drying and dyeing with reaction, direct, acid, or water-soluble sulfur dyes in the absence of an alkali or reducing agent.

3. The process as claimed in claim 1, wherein the cationizing agent used is a quaternized or unquaternized reaction product of polyethyleneimines of the formula $$H—(CH_2—CH_2—NH)_a\cdot(CH_2—CH_2—\underset{\underset{X}{|}}{N})_b—H \quad \text{(I)}$$

where

X is a radical of the formula $—(CH_2—CH_2—NH—)_c—H$, a and b are independently of each other from 0 to 600 and the sum a+b is from 60 to 600, and c is from 0 to 50, with bifunctional alkylating agents, wherein said bifunctional alkylating agent is of the formula $A'—Z'—A'$ where A' is the group of the formula $—CH_2—Y$, where Y is a substituent which is chlorine, bromine, iodine, —OH, sulfato, sulfonyloxy, or epoxy and Z' is either a direction bond or a divalent straight-chain or branched radical of the formula (III)

$$C_{n'}H_{2n'}— \quad \text{(III)}$$

where n' is from 1 to 4, a divalent radial of the formula (IV)

$$—C_mH_{2m}—D—C_mH_{2m}— \quad \text{(IV)}$$

where m is 1 or 2 and D is —O—, —S—, —NH—, —CO—, —SO—, $—SO_2—$ or phenylene.

4. The process as claimed in claim 1, wherein the cationizing agent used is a polymeric cationizing agent comprised of monomeric units of the formula

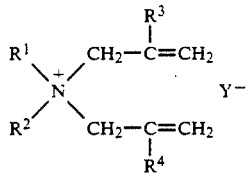

where $R^1$ and $R^2$ are each hydrogen, $C_1$–$C_{22}$-alkyl which may be interrupted by —CO—NH— or —NH—CO—, or $C_1$–$C_4$-hydroxyalkyl, $R^3$ and $R^4$ are each hydrogen or methyl, and Y is a monovalent anion or one equivalent of a polyvalent anion.

5. The process as claimed in claim 4, wherein $R^1$ and $R^2$ are $C_1$–$C_4$-alkyl.

6. The process as claimed in claim 1, wherein the cationizing agent used is a polymeric cationizing agent comprised of monomeric units of the formula

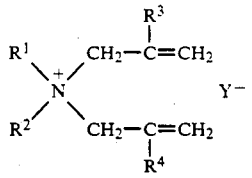

where $R^1$ and $R^2$ are $C_1$-$C_{10}$-alkyl, $R^3$ and $R^4$ are each hydrogen or methyl, and $Y^-$ is a monovalent anion or one equivalent or a polyvalent anion.

7. The process as claimed in claim 1, wherein the cationizing agent used is a quaternized or unquaternized reaction product of an epichlorohydrin and ammonia or an amine of the formula

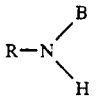

where

B is hydrogen, alkyl of 1 to 5 carbon atoms or hydroxyalkyl of 1 to 5 carbon atoms, R is alkyl of 1 to 5 carbon atoms, hydroxyalkyl of 1 to 5 carbons, a group of the formula

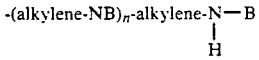

n=0 to 5, a group of the formula

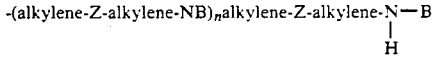

Z=oxygen or sulfur, and n is 0 to 5, or R and B together are

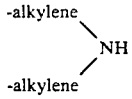

and alkylene is in each case $C_1$-$C_6$-alkylene.

8. The process as claimed in claim 1, wherein the textile material consists essentially of cotton.

9. The process as claimed in claim 2, wherein the textile material consists essentially of cotton.

10. The process as claimed in claim 1, wherein the oxidizing agent is a persulfate, a perborate, a chlorine-containing amide, hydrogen peroxide, sodium chlorite, or sodium hypochlorite.

11. The process as claimed in claim 10, wherein the oxidizing gent is applied in the form of a formulation containing a thickener, a wetting agent, a dispersant, an antifoaming agent, or a stabilizer.

12. The process as claimed in claim 2, wherein the oxidizing agent is a persulfate, a perborate, a chlorine-containing amide, hydrogen peroxide, sodium chlorite, or sodium hypochlorite.

13. The process as claimed in claim 3, wherein the bifunctional alkylating agent is a compound selected from the group consisting of epichlorohydrin, glycide, 1,3-dichloropropan-2-ol, β,β'-dichlorodiethyl ether, β,β'-dichlorodiethylamine, β,β'-dichlorodiethyl sulfide, β,β'-dichlorodiethyl sulfoxide, β,β'-dichlorodiethyl sulfone, β,β'-disulfatoethyl ether, β,β'-diphenylsulfonyloxyethyl ether, meta-diepoxyethylbenzene, para-diepoxyethylbenzene, meta-diepoxypropylbenzene, para-diepoxypropylbenzene, diepoxybutane, diepoxy-2-methylbutane and diepoxypropyamine.

14. A process for producing pattern effects when dyeing or printing, in the absence of alkali or reducing agents, textile material comprising cotton or a mixture of cotton with synthetic fibers or other natural fibers, which process comprises:

pretreating the textile material with at least one of the following compounds:

(a) a quaternized or unquaternized reaction product of a polyethyleneimine of the formula I

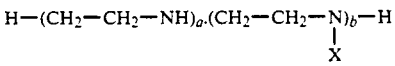

(I)

where

X is a radical of the formula $(CH_2—CH_2—NH-)_c—H$ a and b are independently of each other from 0 to 600 and the sum a+b is from 60 to 600, and c is from 0 to 50, with a bifunctional alkylating agent, wherein said bifunctional alkylating agent is of the formula

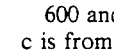

where A' is the group of the formula $—CH_2—Y$, where Y is a substituent which is chlorine, bromine, iodine, —OH, sulfato, sulfonyloxy, or epoxy and Z' is either a direct bond or a divalent straight-chain or branched radical of the formula (III)

(III)

where n' is from 1 to 4, a divalent radical of the formula (IV)

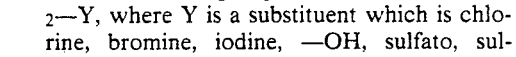

(IV)

where m is 1 or 2 and D is —O—, —S—, —NH—, —CO—, —SO—, $—SO_2—$ or phenylene, (b) a quaternized or unquaternized reaction product of an epichlorohydrin and ammonia or an amine of the formula II

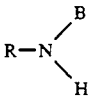

where

B is hydrogen, alkyl of 1 to 5 carbon atoms or hydroxyalkyl of 1 to 5 carbon atoms, R is alkyl of 1 to 5 carbon atoms, hydroxyalkyl of 1 to 5 carbon atoms, a group of the formula $$-(\text{alkylene}-NB)_n\text{alkylene}-\underset{\underset{H}{|}}{N}-B;$$

n=0 to 5, a group of the formula $$-(\text{alkylene-Z-alkylene-NB})_n\text{alkylene-Z-alkylene-}\underset{\underset{H}{|}}{N}-B;$$

Z=oxygen or sulfur, and n is 0 to 5, or R and B together are

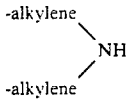

and alkylene is in each case $C_1$–$C_6$-alkylene, or (c) a polymeric agent comprised of monomeric units of the formula (III)'

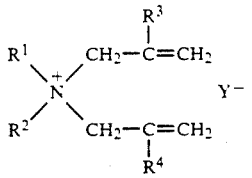

(III)' where $R^1$ and $R^2$ are each hydrogen, $C_1$–$C_{22}$-alkyl which can be interrupted by —CO—NH— or —NH—XO—, or $X_1$–$C_4$-hydroxyalkyl, $R^3$ and $R^4$ are each hydrogen or methyl, and Y is a monovalent anion or one equivalent of a polyvalent anion, drying the pretreated textile material, applying an oxidizing agent to the material in the form of a pattern, and drying and, in the absence of any alkali or reducing agent, dyeing or printing with a reactive, direct, acid, or water soluble sulfur dye to obtain a printed or dyed textile material exhibiting said pattern effects.

15. The process as claimed in claim 14, wherein the oxidizing agent is a persulfate, a perborate, a chlorine-containing amide, hydrogen peroxide, sodium chlorite, or, sodium hypochlorite.

16. The process as claimed in claim 14, wherein the textile material is pretreated with said compound of formula III, and wherein $R^1$ and $R^2$ of said formula III are $C_1$–$C_{10}$-alkyl.

17. The process as claimed in claim 2 wherein the textile material is pretreated with said compound of formula (III)', and wherein $R^1$ and $R^2$ of said formula (III)' are $C_1$–$C_{10}$-alkyl.

* * * * *